US009333507B2

(12) United States Patent
Foucher et al.

(10) Patent No.: US 9,333,507 B2
(45) Date of Patent: May 10, 2016

(54) AUTOMATIC BALL CHARGING SYSTEM FOR A BALL MILL ASSEMBLY

(71) Applicant: Knight Industrial Equipment Inc., Lakeland, FL (US)

(72) Inventors: Raymond J. Foucher, Lakeland, FL (US); Christopher S. Lazenby, Lakeland, FL (US); Brian M. Popp, Lakeland, FL (US); Robert C. Knight, Lakeland, FL (US)

(73) Assignee: KNIGHT INDUSTRIAL EQUIPMENT INC., Lakeland, FL (US)

( * ) Notice: Subject to any disclaimer, the term of this patent is extended or adjusted under 35 U.S.C. 154(b) by 547 days.

(21) Appl. No.: 13/804,061

(22) Filed: Mar. 14, 2013

(65) Prior Publication Data

US 2014/0197257 A1 Jul. 17, 2014

Related U.S. Application Data

(60) Provisional application No. 61/752,696, filed on Jan. 15, 2013.

(51) Int. Cl.

| | |
|---|---|
| ***B02C 17/20*** | (2006.01) |
| *B02C 17/18* | (2006.01) |
| *B02C 17/16* | (2006.01) |

(52) U.S. Cl.

CPC ..... *B02C 17/205* (2013.01); *B02C 17/16* (2013.01); *B02C 17/183* (2013.01)

(58) Field of Classification Search

CPC .... B02C 17/205; B02C 17/183; B02C 17/16; B02C 25/00

USPC ..... 241/33, 34, 98, 170–176, 222, 224, 241/186.2

See application file for complete search history.

(56) References Cited

U.S. PATENT DOCUMENTS 2,737,319 A 3/1956 Rayburn
2,779,506 A * 1/1957 Gajda ..... B65B 3/003 141/116

(Continued)

FOREIGN PATENT DOCUMENTS

BG 108588 8/2005
BG 66097 4/2011

(Continued)

OTHER PUBLICATIONS

Brazin, C. et al., Calibration of the perfect mixing model to a dry grinding mill; Powder Technology 149 (2005) 93-105.

(Continued)

*Primary Examiner* — Faye Francis
*Assistant Examiner* — Onekki Jolly
(74) *Attorney, Agent, or Firm* — Ferris H. Lander, Inc.

(57) ABSTRACT

The present invention is directed toward a material handling, processing and milling facility which utilizes ball milling as a means for material grinding, mixing or mechanical alloying of materials. The system includes an automatic ball charging, agitating and indexing assembly, constructed and arranged to deagglomerate and directly distribute a plurality of grinding balls to the facility. Additional components of the system include an open raceway, in mechanical engagement with the automatic ball charging, agitating and indexing assembly, a bucket elevator for receiving the grinding balls from the open raceway and elevating them to a gravity fed transport system, at least one transporting device for receiving the grinding balls from the bucket elevator; and a ball mill for receiving the grinding balls from the at least one transporting device.

5 Claims, 8 Drawing Sheets

(56) References Cited

U.S. PATENT DOCUMENTS

| | | | | |
|---|---|---|---|---|
| 3,401,893 | A | 9/1968 | Reynolds | |
| 3,690,570 | A | 9/1972 | Root | |
| 3,773,268 | A | 11/1973 | Bond | |
| 3,999,753 | A | 12/1976 | Desilets | |
| 4,013,233 | A | 3/1977 | Nylund | |
| 4,062,497 | A | 12/1977 | Kemp, Jr. | |
| 4,065,061 | A | 12/1977 | Bombled | |
| 4,267,981 | A | 5/1981 | Rowland, Jr. | |
| 4,289,254 | A | 9/1981 | Spring | |
| 4,304,362 | A | 12/1981 | Buhler | |
| 4,627,555 | A * | 12/1986 | Locke | G01F 11/20 222/200 |
| 4,643,365 | A | 2/1987 | McKim | |
| 4,715,546 | A * | 12/1987 | Holming | B02C 17/205 241/171 |
| 4,726,531 | A | 2/1988 | Strasser | |
| 4,998,678 | A | 3/1991 | Durr | |
| 5,005,770 | A | 4/1991 | Suessegger | |
| 5,224,659 | A | 7/1993 | Gabardi | |
| 5,513,803 | A | 5/1996 | Czekai | |
| 5,570,844 | A | 11/1996 | Thomart | |
| 5,678,776 | A | 10/1997 | Zoz | |
| 5,865,385 | A | 2/1999 | Arnett | |
| 5,882,246 | A | 3/1999 | Inkyo | |
| 6,149,014 | A | 11/2000 | Mankosa | |
| 6,405,662 | B1 | 6/2002 | Williams | |
| 6,619,572 | B1 | 9/2003 | Macy | |
| 2006/0194685 | A1 * | 8/2006 | Lewis-Gray | B01D 17/0217 494/33 |
| 2009/0084876 | A9 * | 4/2009 | Chapman | A01G 3/002 241/30 |
| 2010/0170975 | A1 | 7/2010 | Bell | |

FOREIGN PATENT DOCUMENTS

| | | |
|---|---|---|
| CN | 2664769 | 12/2004 |
| CN | 101569871 | 11/2009 |
| CN | 101712031 | 5/2010 |
| CN | 102581746 | 7/2012 |
| RS | 20080354 | 6/2010 |
| WO | 2011128505 | 10/2011 |

OTHER PUBLICATIONS

Bouteiller, Caroline Le et al., Aggregate breakage under dynamic loading, Granular Matter (2011) 13:385-393.

Chen, Xi-song et al., Supervisory expert control for ball mill grinding circuits, ScienceDirect, Expert Systems with Applications 34 (2008) 1877-1885.

Concha, F. et al., Optimization of the make-up ball charge in grinding mill, International Journal of Mineral Processing, 34 (1992) 231-241.

Fuerstenau, D.W. et al., Scale Up of Lifters in Ball Mills, International Journal of Mineral Processing, 15 (1985) 183-192.

Karra, V.K., et al, The Scale-Up of Grate-Discharge Continuous Ball Mills, Intenational Journal of Mineral Processing, 2 (1977) 1-6.

Katubilwa, Francois, et al., Effect of ball size distribution on milling rate, Minerals Engineering 22 (2009) 1283-1288.

Kiangi, Kiangi K., et al., Particle filling and size effects on the ball load behaviour and power in a dry pilot mill: Experimental study, Powder Technology 187 (2008) 79-87.

Magoload, Automated Ball Loader, Optimization & Mill management tools, pp. 1-2.

Outotec MillSense, An intelligent mill analyzer, 2009, pp. 001-007.

Weedon, D.M., A Perfect Mixing Matrix Model for Ball Mills, Minerals Engineering, vol. 14, No. 10, pp. 1225-1236, 2001.

* cited by examiner

AUTOMATIC BALL CHARGING SYSTEM FOR A BALL MILL ASSEMBLY

CROSS-REFERENCE TO RELATED APPLICATIONS

This application claims benefit of priority to U.S. Provisional Patent Application Ser. No. 61/752,696, filed on Jan. 15, 2013, the contents of which are herein incorporated by reference in its entirety.

FIELD OF THE INVENTION

This invention relates generally to ball mill grinding assemblies, and particularly to ball mill grinding assemblies including an automatic ball charging and indexing device.

BACKGROUND OF THE INVENTION

In general, a ball mill is configured as a cylindrical device, and is utilized for grinding crushed materials. Ball mills are widely used in production lines for powders such as cement, silicates, refractory material, fertilizer, glass ceramics, and the like. Ball mills are also used for ore dressing of both ferrous and non-ferrous metals. A ball mill is capable of grinding various ores and other materials either wet or dry. There are many types of grinding media suitable for use in a ball mill, each material having its own specific properties and advantages. Key properties of grinding media are size, density, hardness, and composition.

Ball mills rotate around a horizontal axis, partially filled with the material to be ground plus the grinding medium. Different materials are used as media, including ceramic balls, flint pebbles and steel balls. An internal cascading effect reduces the material to a fine powder. Industrial ball mills can operate continuously, fed at one end and discharged at the other end. Large to medium-sized ball mills are mechanically rotated on their axis, but small ones normally consist of a cylindrical capped container that sits on two drive shafts (pulleys and belts are used to transmit rotary motion). High-quality ball mills are potentially expensive and can grind mixture particles to as small as 5 nm, enormously increasing surface area and reaction rates.

During the ball milling operation, the grinding media, e.g. the steel balls, wear down and need to be replenished. This has typically been a manual operation, which is both tedious and dangerous. Grinding balls need to be added often in order to maintain optimum grinding characteristics. Steel balls, for example, may need to be replenished at a rate of about 100 barrels per month. Each barrel weighs approximately 2,000 pounds, and the balls must be added to the system in a controlled fashion. This is generally a two-person operation. The task is further complicated by the fact that natural weathering causes bridging and agglomeration of the balls, which further heightens the danger and difficulty of controlled stepwise addition of the grinding media to the system.

The present inventors have developed an assembly for automatically feeding grinding media to a ball mill assembly which mitigates the danger and provides an assembly of elements for receipt of grinding media and controlled addition to one or more ball mill grinders, so as to insure that optimal grinding parameters are maintained.

DESCRIPTION OF THE PRIOR ART

U.S. Pat. No. 5,224,659 to Gabardi discloses an apparatus for feeding balls to a grinding mill. The apparatus includes a downwardly inclined chute adapted to receive balls from a bin or hopper, and for delivering the balls to the grinding mill. Means for sequentially feeding the balls, one-at-a-time, to the grinding mill are provided, including a first actuator and a second actuator. Each of the actuators preferably includes an extension arm mounted for rotation along the longitudinal axis of the chute. The first actuator is for restraining balls from traveling down the chute and works in conjunction with the second actuator for isolating the lowermost ball in the chute to be fed next to the grinding mill. The second actuator is for releasing the isolated ball. The feeding means may include a computer controller for operating each of the actuators at a predetermined time interval corresponding to the ball attrition rate of the grinding mill. A magnetic sensor may be positioned inside the chute downstream from the actuators for sensing passage of the isolated ball through the chute for providing feedback to the controller.

U.S. Pat. No. 4,643,365 to McKim discloses an apparatus for adding grinding media to a grinding mill. The apparatus comprises a supporting structure including a face plate adapted to be mounted on a wall of a hopper or pipe containing the grinding media, a resilient rubber wheel mounted on the supporting structure and protruding through a slot in the face plate and said wall of the media container, and means for rotating said wheel at a low speed for withdrawing grinding media from said container and delivering the same to other conveyances for direction to the grinding mill.

U.S. Pat. No. 4,715,546 to Holming et al. discloses an apparatus for uniformly feeding grinding balls to a grinding mill. The apparatus includes a ball storage hopper, a regulator and an inclined chute for conveying balls from the hopper to the regulator. The chute includes a panel for controlling the depth of the balls. The regulator includes a discharge drum having a plurality of compartments adapted to receive the balls, an electric motor for rotating the drum, and a means for retaining the balls in the drum. The drum is rotated at a predetermined speed and feeds the balls into a mill at a uniform rate, which can be controlled to approximately match the attrition rate of the balls in the mill.

U.S. Pat. No. 3,773,268 to Bond discloses an apparatus for and a method of controlling the feed rate of grinding media to a grinding mill of the type that operates at a power draft in the vicinity of the critical peak power draft of the grinding mill. In the described embodiment, the ore grinding media feed rate to a secondary autogenous grinding mill is controlled. In the described embodiment the ore grinding media feed rate is normally automatically controlled in response to the electrical power demand of the grinding mill by control means whose function is to maintain the power draft of the mill at a predetermined set point. At suitable time intervals, such as once every sixty minutes, the normal automatic feed control for the ore grinding media is interrupted or deactivated and an override feed control for the ore grinding media is substituted in place of the normal feed control. The override feed control acts to substantially decrease the rate of feed of the ore grinding media to the mill sufficiently to cause a measurable effect on the power draft of the mill. During the period when the override control is in effect, the feed of ore grinding media to the mill may even be stopped completely. A sensing device responsive to power increase or decrease detects whether the power input to the mill decreases or increases when the override feed control is in control, thereby indicating whether the mill is loaded below or above the grinding media charge or loading corresponding to the critical peak power draft of the mill. If the sensing device detects a decrease in power input to the mill during the override period, the override ore grinding media feed control is disconnected or otherwise deactivated and the normal ore grinding media feed control is reconnected or otherwise reactivated. If the sensing device detects an increase in power input to the mill during the override period, the override feed control remains connected to provide a decreased rate of feed of ore grinding media, which may even include a complete stoppage of feed of ore grinding media, until the sensing device detects a decrease in power input to the mill, at which time the override ore grinding media feed control is disconnected and the normal ore grinding media feed control is reconnected.

The references fail to teach or suggest a unitary ball feeding and indexing device, that serves the function of deagglomerating and directly distributing a plurality of grinding media (steel/iron balls) to a ball mill grinding system. The references further fail to teach a system whereby the grinding media are automatically indexed, separated from detritus and agitated to prevent agglomeration and bridging, which would otherwise prevent the flow of balls to the indexer wheel, as instantly disclosed.

SUMMARY OF THE INVENTION

Ball mills typically are loaded with iron, steel or ceramic balls, or combinations thereof, about the size of a baseball. The balls rotate within the housing of the mill, macerating/pulverizing the contents to a desired particle size. During this process the balls gradually wear down in size, and must be replaced on a continual basis in order to maintain efficiency. Heretofore feeding of the balls has been a manual job, which is both difficult and dangerous.

The present invention illustrates an auto-feeder system for a ball mill operation. The main component, as illustrated, is a ball indexer which permits balls (in bulk) to be filled into a hopper where they are agitated in order to deagglomerate them, and then the balls are metered out via the ball indexer, through a perforated chute (which allows for the jettisoning of extraneous materials) to a ball feed elevator, toward a diverter gate assembly (when multiple ball mills reside within the system), and ultimately to the ball mills themselves.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 9 is an illustrative section view of the auto ball charger and indexer/agitator assembly, which illustrates the movement of the balls there through.

DETAILED DESCRIPTION OF THE INVENTION

The invention is directed toward a material handling, processing and milling facility which utilizes ball milling as a means for material grinding, mixing or mechanical alloying of materials such as ores, chemicals, ceramic raw materials and paints.

Figure 1:
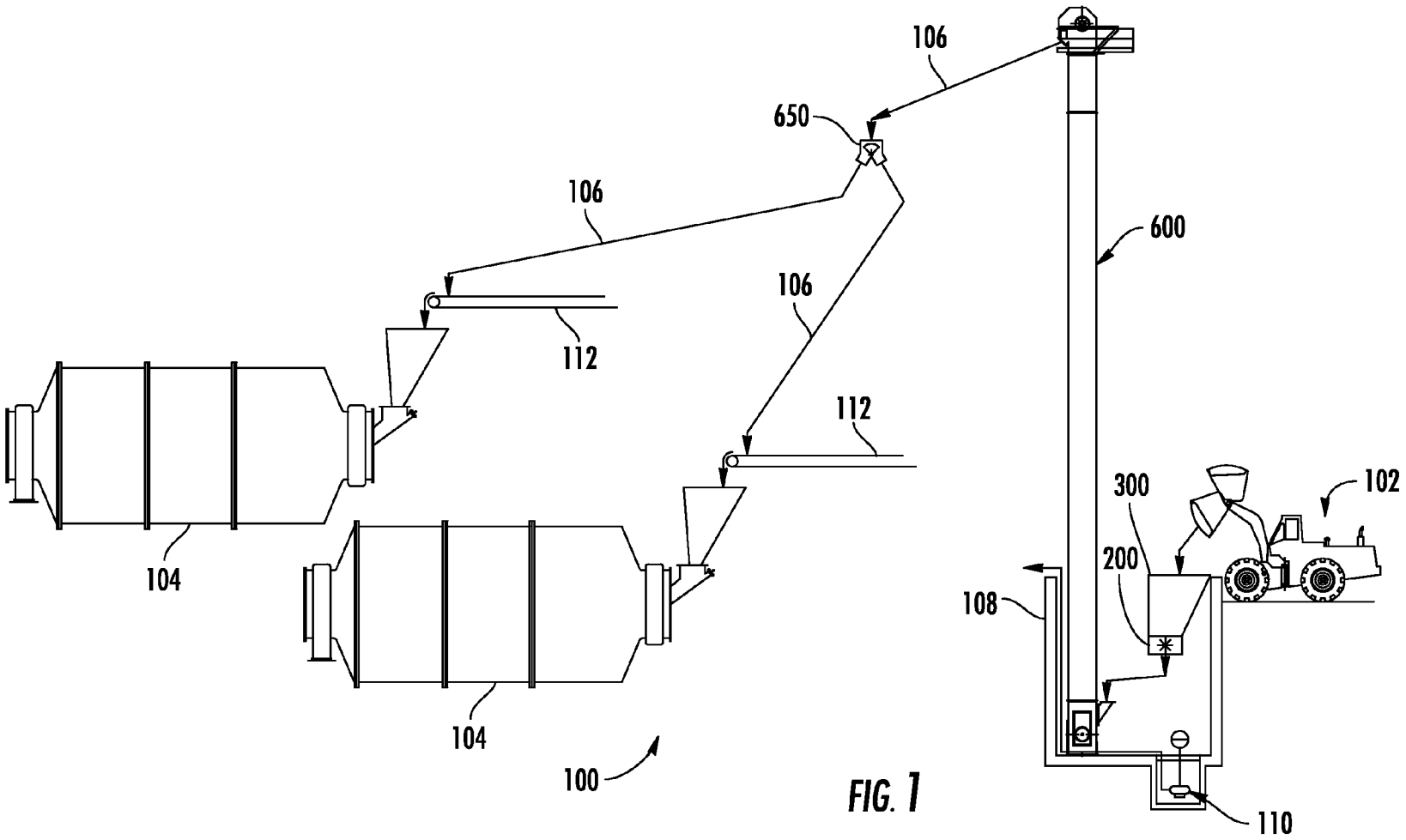
FIG. 1 is a descriptive stepwise illustration of the ball milling system.

With reference to FIG. 1, an overview of the generalized components of a ball milling operation 100, in accordance with the instant invention, are illustrated therein. In accordance with one illustrative, albeit non-limiting embodiment of the invention, a front-end loader 102 or functionally equivalent loading device, is used to place grinding balls 606 (shown in FIGS. 6A and 6B) into a ball feed hopper 300, subsequent to which the balls 606 enter the auto ball charger and agitator/indexer assembly 200. From the auto ball charger and agitator/indexer assembly the balls travel through a self-cleaning stainless steel round bar raceway ball track 400 (see FIG. 4), which is constructed and arranged to allow material debris and water to fall to the floor below before entering the bucket elevator assembly 600. In order to remove excess accumulated water and debris a sump pump 110 is provided, as well as a sump discharge 108. The balls 606 then load into buckets 604 on the elevator (see FIG. 6A). The bucket elevator assembly 600 elevates the grinding balls to a suitable height so that they may be gravity fed, via a transport system including pipe chutes 106 or the like transport device, to the ball mills 104. The bucket elevator assembly 600 is provided with ultra high molecular weight polymer impact flaps 602 at critical junctures to prevent undue wear, as well as being reinforced with steel plates (not shown) having a vertical barrier of sufficient height to prevent balls from dropping through to the bottom of the elevator. At the top of the elevator 600, the balls 606 are discharged into a pipe chute 106, flume or other functionally equivalent device constructed and arranged for receipt of balls 606, for subsequent transport to a conveyor 112, and ultimately to the ball mills 104 themselves, for replenishing the supply of balls 606 therein. When a plurality of ball mills exists, the pipe chute 106 is directed toward a diverter gate assembly 650 (see FIG. 6B). In such a configuration, the pipe chute 106 splits after the diverter gate assembly 650, and feeds into the entry points of each of the ball mills 104. The diverter gate assembly 650 is essentially a diverter valve whose function is to select which of the one or more ball mills 104 is to receive additional balls 606 at that time.

Figure 2:
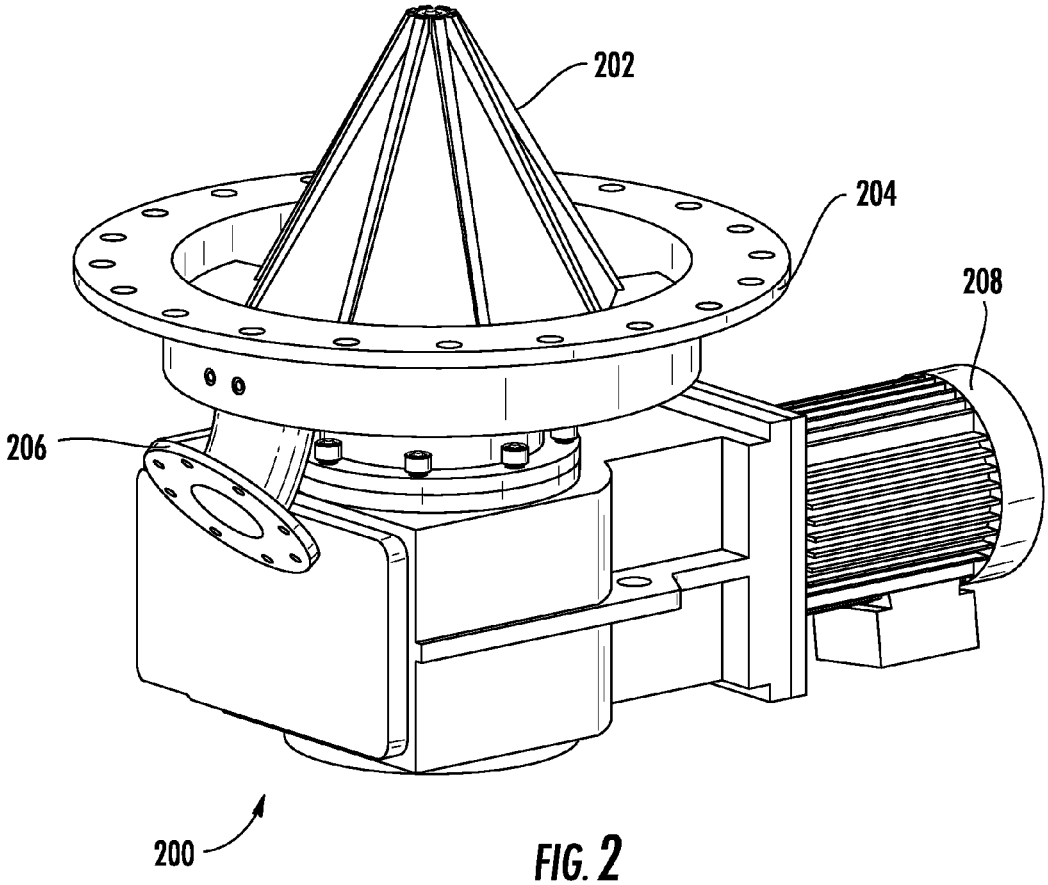
FIG. 2 is a perspective view of the auto ball charger and agitator/indexer assembly.

Referring now to FIG. 2, a perspective view of the auto ball charger and agitator/indexer assembly 200, hereinafter referred to as the Ball Indexer Assembly, is shown. The conical agitator 202 is constructed and arranged to be rotated by virtue of its mechanical engagement with the gearmotor 208. Ball indexer assembly hopper connecting flange 204 is designed to interface with a corresponding ball hopper connecting flange 304 integral to the ball hopper 300. Ball indexer assembly raceway connecting flange 206 is likewise designed to interconnect with raceway connecting flange 406, integral to the raceway 400.

Figure 3:
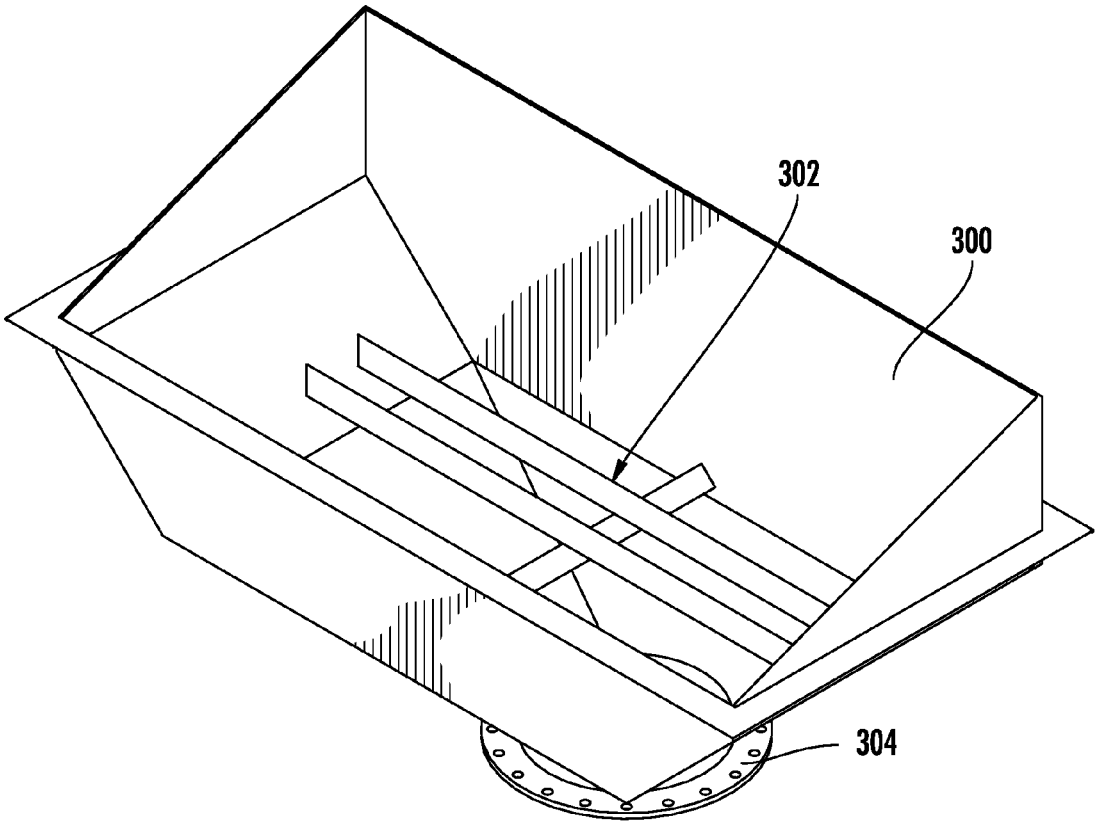
FIG. 3 is a perspective view of the hopper assembly which attaches to the auto ball charger and agitator/indexer assembly.

With further reference to FIG. 3, a perspective view of the ball hopper 300 which is constructed and arranged for removable mechanical engagement with the ball indexer assembly 200 is shown. In operation, the ball hopper 300 is in mechanical engagement with the ball indexer assembly 200, via fastening of ball indexer assembly hopper connecting flange 204 with ball hopper connecting flange 304. Balls 606 are fed into the hopper 300 via the use of front-end loader 102 or any functionally equivalent loading configuration. If desired, in order to aid in initial separation of the balls 606, deflector angles 302 are provided.

Figure 4:
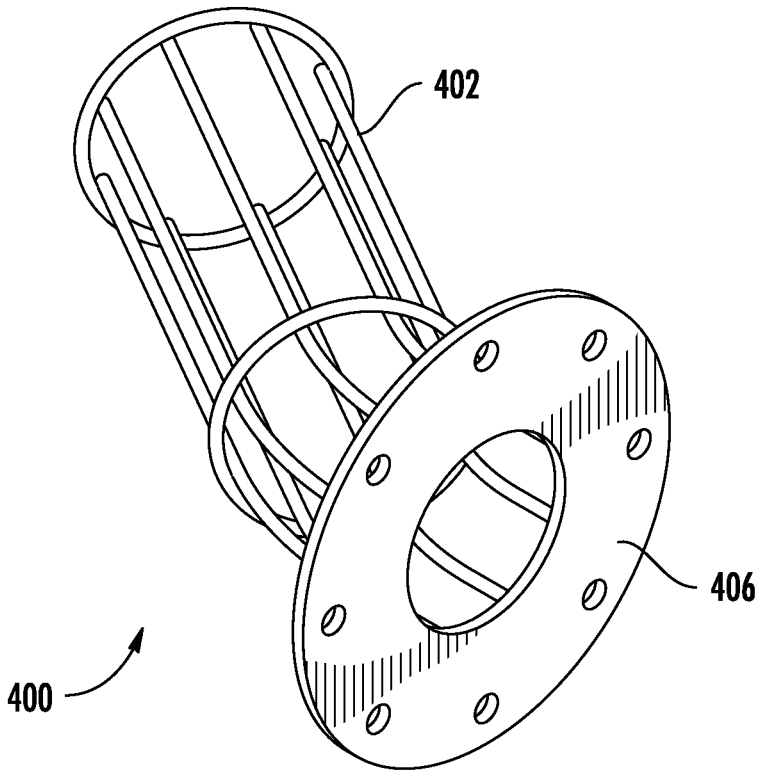
FIG. 4 is perspective view of the open wire raceway which couples to the outlet of the auto ball charger and agitator/indexer assembly.
Figure 5:
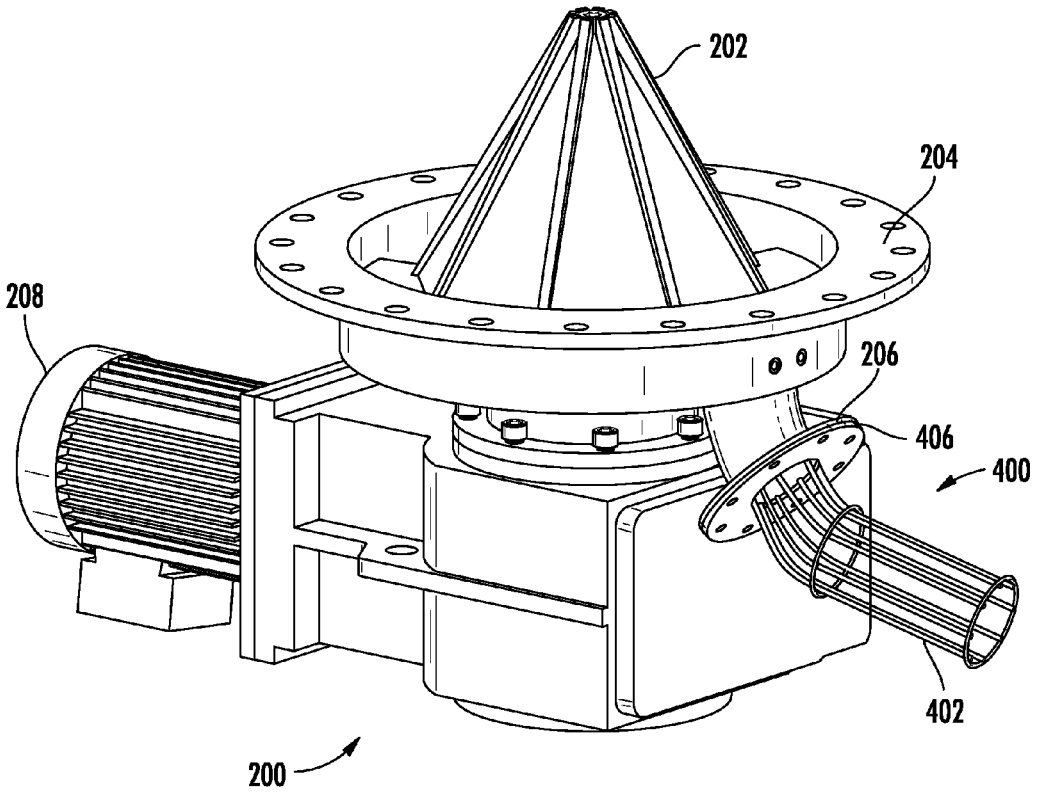
FIG. 5 is a perspective view of the auto ball charger and agitator/indexer assembly coupled to the open wire raceway.

As further illustrated in FIGS. 4 and 5, a raceway 400 is provided. The raceway is of an open configuration, and is assembled from a plurality of shaped and connected rods 402. In an embodiment, the rods may be stainless steel, or any equivalent material suitable for the specific material needs and environment of a particular operation. In operation, the raceway 400 is in mechanical engagement with the ball indexer assembly 200 via fastening of the ball indexer assembly raceway connecting flange 206 with raceway connecting flange 406. The open design of the raceway provides a unique function while bridging the distance between the ball indexer assembly 200 and the bucket elevator assembly 600, by allowing any water, dirt, rust, debris, or the like, to separate out from the balls 606 before they enter the bucket elevator assembly 600.

Figure 6A:
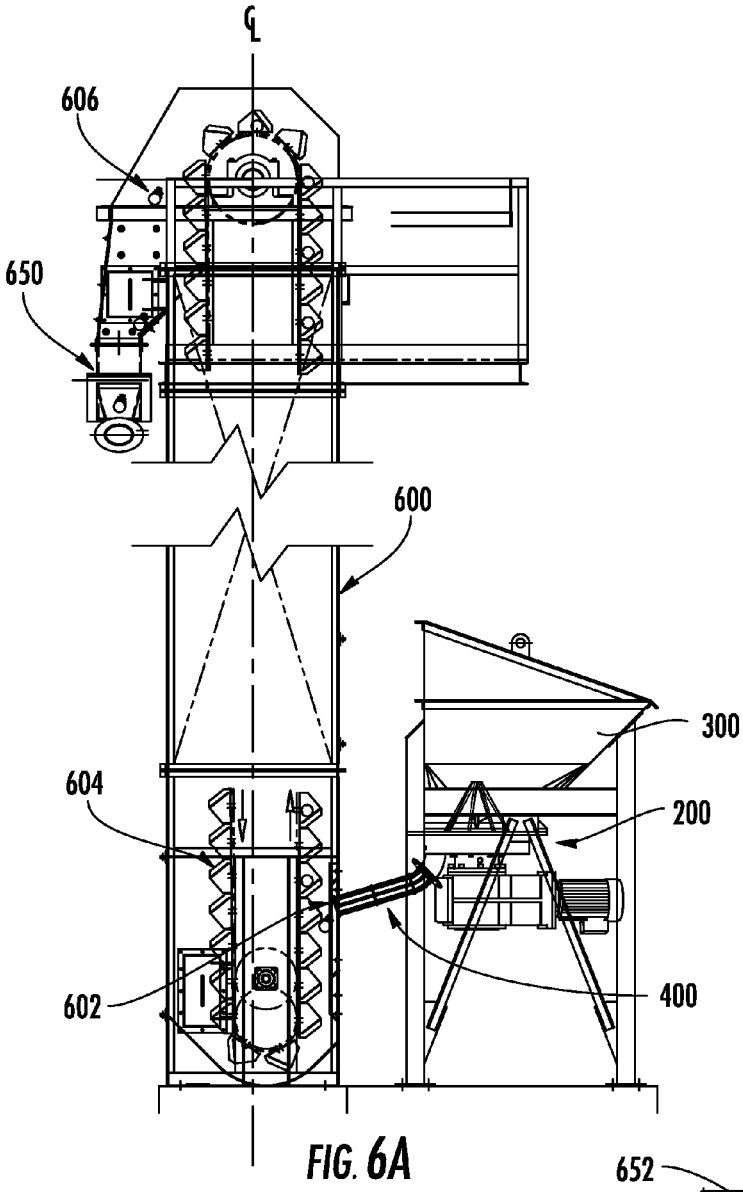
FIG. 6A is a sectional view of the bucket elevator assembly fed by the auto ball charger and agitator/indexer assembly, via the open wire raceway.

Referring now to FIG. 6A, a sectional view of the bucket elevator assembly 600 fed by the ball indexer assembly 200, via the open wire raceway 400 is shown. Balls 606 travel from the hopper 300, where they are agitated and deagglomerated, through the ball indexer assembly 200, and into the raceway 400, through which they travel into the bucket elevator assembly 600. As balls 606 enter the bucket elevator assembly 600, they come into contact with impact flap 602, which slows the momentum of the balls 606 so as to prevent damage to the buckets 604. The balls 606 are then directed into individual buckets 604 which carry them upwards to exit from the bucket elevator assembly 600 into pipe chute 106 and subsequently into diverter gate assembly 650. Of course it is understood that if only a single ball mill device 104 is present, then the need for the diverter gate assembly 650 is obviated.

Figure 6B:
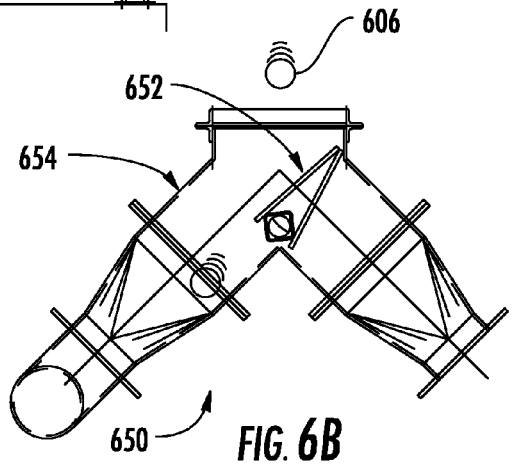
FIG. 6B is a sectional view of a diverter gate assembly which receives balls which exit the auto ball charger and agitator/indexer assembly.

Referring more particularly to FIG. 6B, where a cross-sectional view of the diverter gate assembly 650 is shown, it can be seen that a diverter blade 652 is designed to be pivoted between a first position and a second position, whereby the grinding balls 606 are guided to one of the diverter gates 654, and ultimately to one ball mill or another in order to maintain optimum grinding parameters in each of the ball mills.

Figures 7, 8:
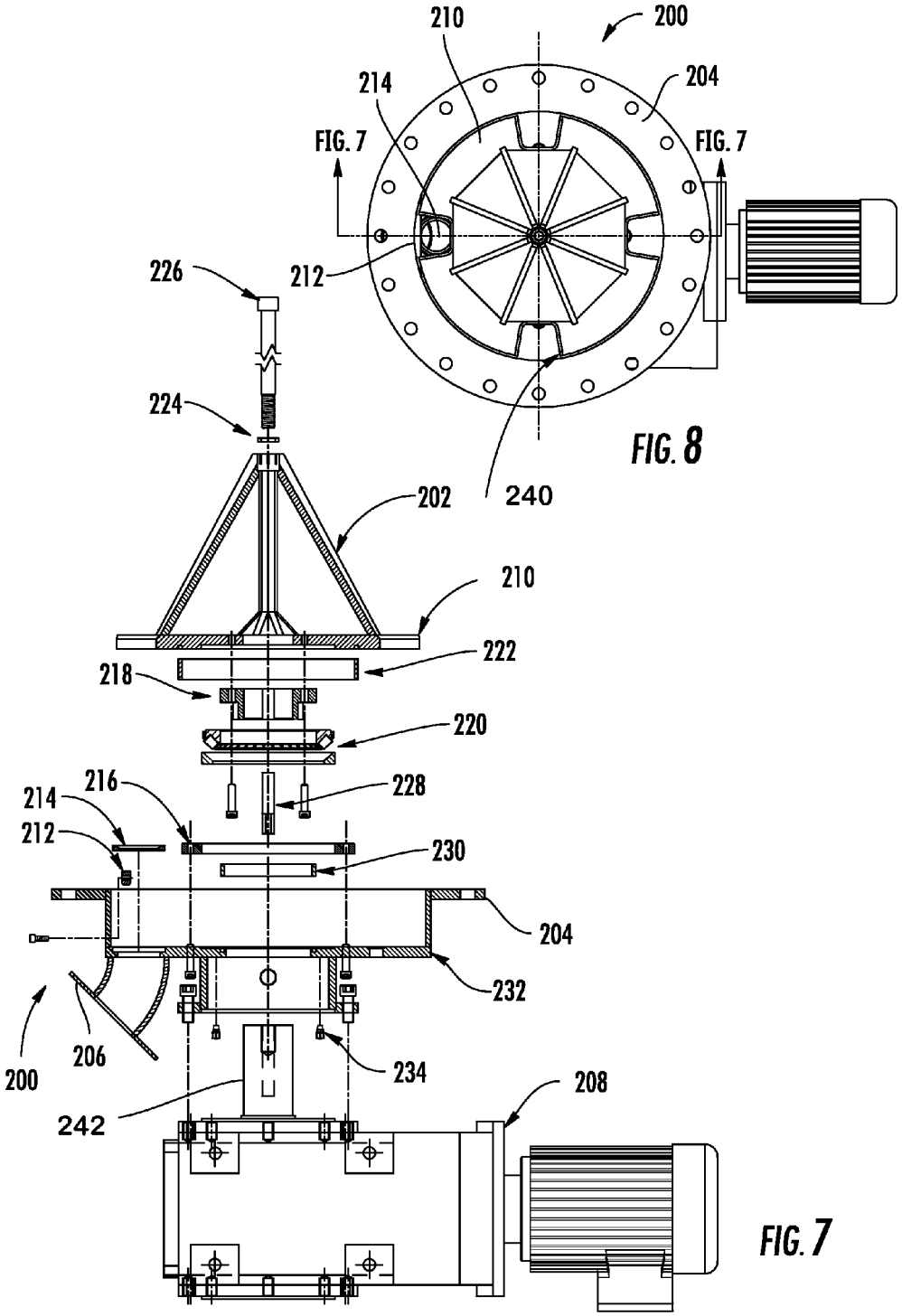
FIG. 7 is an exploded view of the auto ball charger and agitator/indexer assembly.
FIG. 8 is a top view of the auto ball charger and agitator/indexer assembly.

In order to better understand the operation of the ball indexer assembly 200, an exploded view is shown in FIG. 7, which is taken through line 1-1 of FIG. 8. of the ball indexer assembly 200. In this view the hopper 300 is removed for clarity.

The ball indexer assembly 200 is designed to perform a dual function. It receives grinding balls 606 from a bulk source, e.g. front end loader 200, a railroad car, dump truck or the like. The balls 606, first impact the rotating conical agitator 202 to prevent agglomeration and bridging, which would prevent the flow of balls 606 from reaching the slotted indexer wheel 210, which is illustrated as containing four slots 240, albeit this is a non-limiting configuration. Continual rotation of the now deagglomerated balls 606 allows them to fall into (4) four grinding ball receiving slots 240 in the slotted indexer wheel 210 located in the periphery thereof. The balls 606 then fall through the window insert 214. The window insert 214 is a replaceable wear item, which can also be changed to allow for different sized balls. The speed of the gearmotor 208 is adjusted such that the balls 606 are fed at the desired controlled feed rate and the proper trajectory through the window insert 214. In order to insure centering of the balls 606 in the window insert 214 a centering block 212 is provided. This piece is also a replaceable wear item that can be changed to accommodate different sized balls.

Rotation of the agitator 202 and indexer wheel 210 is effectuated via the gearmotor 208. Gearmotor 208 is bolted to hopper bottom 232. The torque of the gearmotor shaft 242 is transmitted through bearing shaft 218, which is bolted to the slotted indexer wheel 210.

The gearmotor shaft 242 is connected to bearing shaft 218 via output shaft 228. The rotational, thrust and axial forces are transmitted through bearing 220, which is retained by bearing collar 216 on the outer race and bearing shaft 218 on the inner race. The bearing 220 is protected from dirt and water intrusion by bearing seal 222. Grease is retained in the bearing 220 by bearing seal 222 and inner bearing seal 230. The bearing is supplied with lubrication grease through grease fitting 234, which is installed in tapped holes in the hopper bottom 232.

FIG. 8 is a top view of the ball indexer assembly 200, which more clearly illustrates the relationship as earlier explained between slotted indexer wheel 210, window insert 214 and centering block 212.

Figure 9:
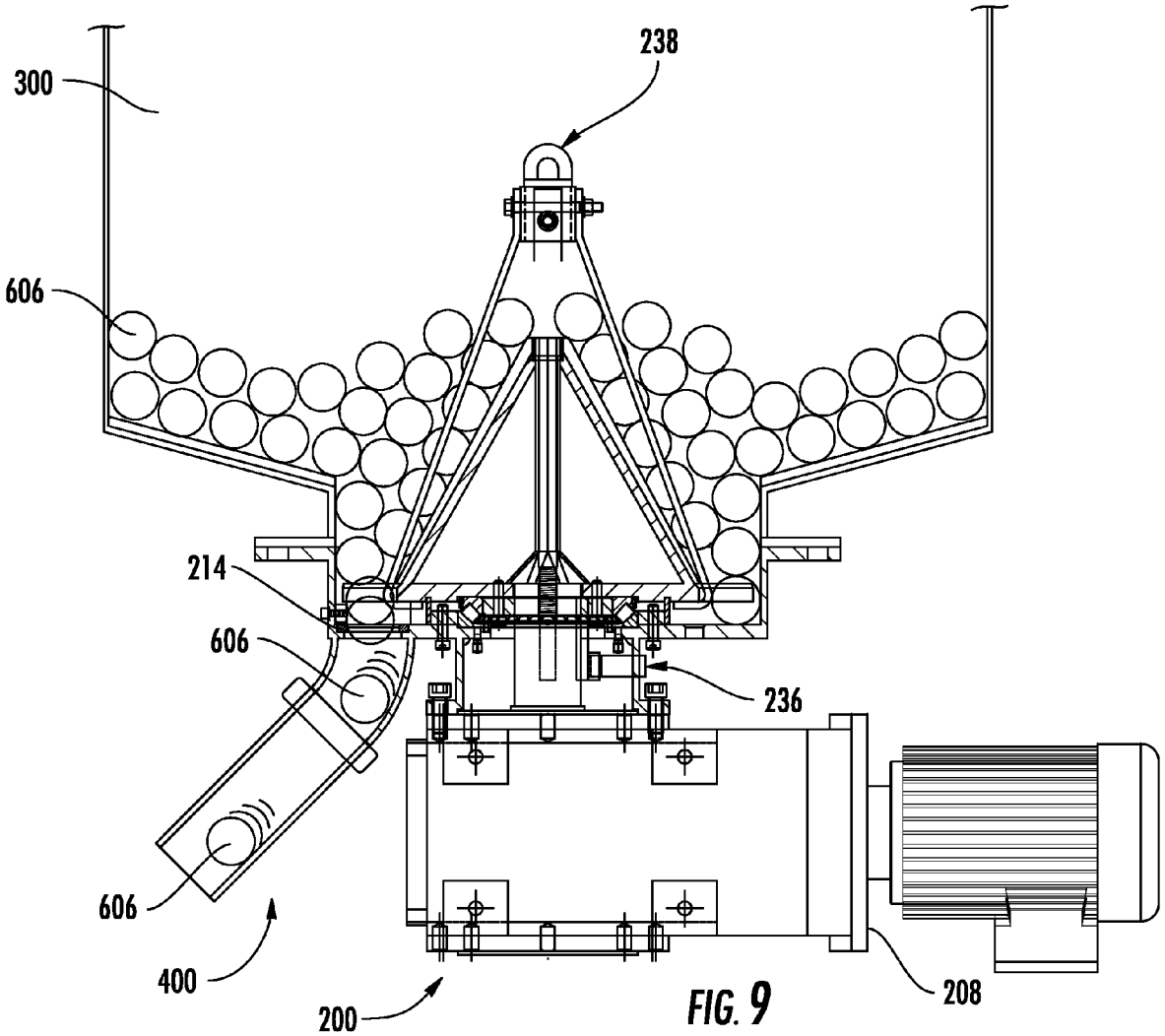

FIG. 9 is an illustrative section view of the relationship of hopper 300 to the ball indexer assembly 200, which illustrates the movement of the balls 606 there through. As balls 606 line up over window insert 214 they sequentially drop down into raceway 400. The rapidity by which they fall is governed by the speed of rotation of the gearmotor 208, which is a process parameter governed by the overall grinding process. Proximity sensor 236 has been included to provide added safety features. The purpose of the proximity sensor 236 is to locate the slots in the slotted indexer wheel 210 so that when the system is turned off, a slot does not stop over the top of the window insert 214. This is done to prevent balls from going through the ball indexer assembly 200 when stopped to prevent accumulation in the raceway and jamming. As a secondary function, the proximity sensor 236 provides an indication of rotation or lack thereof, e.g. zero speed sensing. When it is desired to remove the agitator 202, lifting ring 238 is provided.

All patents and publications mentioned in this specification are indicative of the levels of those skilled in the art to which the invention pertains.

All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. An automatic ball charging, and agitating/indexing assembly, comprising:

a hopper receiving a supply of grinding balls;

a rotatable conical agitator constructed and arranged to prevent agglomeration and bridging of said grinding balls;

a slotted indexer wheel for receiving grinding balls therein, said indexer wheel containing a plurality of grinding ball receiving slots;

a hopper bottom, in mechanical engagement with said hopper, having a window for sequential passage therethrough of each said grinding ball, from said grinding ball receiving slots; and a gearmotor, in mechanical engagement with said rotatable conical agitator, for providing rotational force thereto.

2. The automatic ball charging, and agitating/indexing assembly of claim 1, wherein said automatic ball charging and agitating/indexing assembly further includes a window insert constructed and arranged for insertion within said hopper bottom window, whereby said window insert may be changed to accommodate different sized grinding balls.

3. The automatic ball charging, and agitating/indexing assembly of claim 2, wherein said automatic ball charging and agitating/indexing assembly further includes a centering block constructed and arranged for positioning adjacent said hopper bottom window, to insure centering of said grinding balls in said window insert.

4. The automatic ball charging, and agitating/indexing assembly of claim 1, wherein said automatic ball charging and agitating/indexing assembly further includes an open raceway, in mechanical engagement with said automatic ball charging and agitating/indexing assembly, for removal of said grinding balls therefrom.

5. The automatic ball charging, and agitating/indexing assembly of claim 4, wherein said automatic ball charging and agitating/indexing assembly further includes a proximity sensor to detect the positioning of said slotted indexer wheel to prevent grinding balls from entering and accumulating in said open raceway when the automatic ball charging, and agitating/indexing assembly is not running.

* * * * *